US006184861B1

(12) United States Patent
Callway

(10) Patent No.: US 6,184,861 B1
(45) Date of Patent: Feb. 6, 2001

(54) METHOD AND APPARATUS FOR PROCESSING VIDEO AND GRAPHICS DATA UTILIZING INTENSITY SCALING

(75) Inventor: Edward G. Callway, Toronto (CA)

(73) Assignee: ATI Technologies, Inc., Thornhill (CA)

( * ) Notice: Under 35 U.S.C. 154(b), the term of this patent shall be extended for 0 days.

(21) Appl. No.: 09/047,299

(22) Filed: Mar. 24, 1998

(51) Int. Cl.[7] ..... G09G 5/10
(52) U.S. Cl. ..... 345/147; 345/153; 345/133
(58) Field of Search ..... 345/115, 116, 345/147, 153, 155, 10, 20; 348/88, 87, 211, 133

(56) References Cited

U.S. PATENT DOCUMENTS 4,626,835 * 12/1986 Nienaber et al. ..... 345/153
5,438,373 * 8/1995 Cummins ..... 348/572
5,469,190 * 11/1995 Masterson ..... 345/155
5,640,332 6/1997 Baker et al. ..... 345/197
5,734,362 * 3/1998 Eglit ..... 345/89
5,796,385 * 8/1998 Rich ..... 345/155
5,828,349 * 10/1998 MacHesney et al. ..... 345/3
5,890,190 * 3/1999 Rutman ..... 711/101
5,907,370 * 5/1999 Suzuki et al. ..... 348/607

* cited by examiner

*Primary Examiner*—Xiao Wu
(74) *Attorney, Agent, or Firm*—Markison & Reckamp, P. C.

(57) ABSTRACT

A method and apparatus for processing video data and graphics data utilizing intensity scaling is accomplished by first determining whether video data or graphics data is being received. When video data is being received, the video data is processed based on a first intensity scaling range to produce intensity processed video data. When graphics data is being received, the graphics data is processed based on a second scaling range to produce intensity processed graphics data. The second intensity scaling range is smaller than the first intensity scaling range. Next, the intensity processed video data and/or the intensity processed graphics data is provided to a display via a digital-to-analog converter (i.e., a DAC). The DAC generates different scaled analog outputs depending on whether the data being converted is graphics or video, where the conversion of the video data is done with diminished intensity.

16 Claims, 4 Drawing Sheets

50

VIDEO GRAPHICS PROCESSING CIRCUIT 50

METHOD AND APPARATUS FOR PROCESSING VIDEO AND GRAPHICS DATA UTILIZING INTENSITY SCALING

TECHNICAL FIELD OF THE INVENTION

The present invention relates generally to video graphic processing and more particularly to processing video data and graphics data utilizing intensity scaling.

BACKGROUND OF THE INVENTION

The basic architecture of computing devices is known to include a central processing unit ("CPU"), system memory, input/output ports, an address generation unit ("AGU"), program control circuitry, interconnecting buses, audio processing circuitry, and video processing circuitry. As the technology of computing device elements continues to advance, computing devices are being used in more and more commercial applications. For example, computer devices are used in video game players, personal computers, work stations, video cameras, video recorders, televisions, etc. The technological advances are also enhancing video quality, audio quality, and the speed at which the computing devices process data. The enhancements of video quality are a direct result of video graphic circuit evolution.

Video graphics circuits have evolved from providing simple text, and/or two-dimensional images to relatively complex three-dimensional images. In addition, video graphics circuit evolution allows computer displays, or monitors, to simultaneously display graphics data and video data. Typically, graphics data is generated by the central processing unit while performing particular software applications such as word processing applications, drawing applications, computer aided drafting applications, etc. Typically, the video data is received via a television encoder as television broadcast signals, cable television signals, satellite television signals, VCR signals, and/or DVD signals. The television encoder converts the video data into digitized video such that the video graphics circuit can process it and display it.

While existing technology allows video data and graphics data to be simultaneously displayed on computer monitors, there are noticeable differences between the displayed graphics data and the displayed video data. The differences arise because televisions (i.e., the normal target for video data) are designed to display low resolution, high intensity analog signals, while computers are designed to display high resolution, low intensity digital signals. When a computer is processing digitized video data, it treats it as graphics data such that it is displayed as low intensity, high-resolution signals. As such, the digitized video data appears dull and somewhat "blocky" on a computer display.

Therefore, a need exists for a method and apparatus that allows video data and graphics data to be displayed simultaneously with minimal visual differences.

DETAILED DESCRIPTION OF A PREFERRED EMBODIMENT

Generally, the present invention provides a method and apparatus for processing video data and graphics data utilizing intensity scaling. This may be accomplished by first determining whether video data and/or graphics data is being received. When video data is being received, the video data is processed based on a first intensity scaling range to produce intensity processed video data. When graphics data is being received, the graphics data is processed based on a second scaling range to produce intensity processed graphics data. The second intensity scaling range is smaller than the first intensity scaling range. For example, the first intensity scaling range may be represented by a nine bit digital word, while the second intensity scaling range may be represented by an eight bit digital word. Next, the intensity processed video data and/or the intensity processed graphics data is provided to a display via a digital-to-analog converter (i.e., a DAC). The DAC generates different scaled analog outputs (e.g., 0-0.7 volts for graphics data, 0 to 1.4 volts for video data) depending on the data being processed. With such a method and apparatus, the perceived differences between video data and graphics data is substantially reduced by increasing the intensity range for video data.

Figure 1:
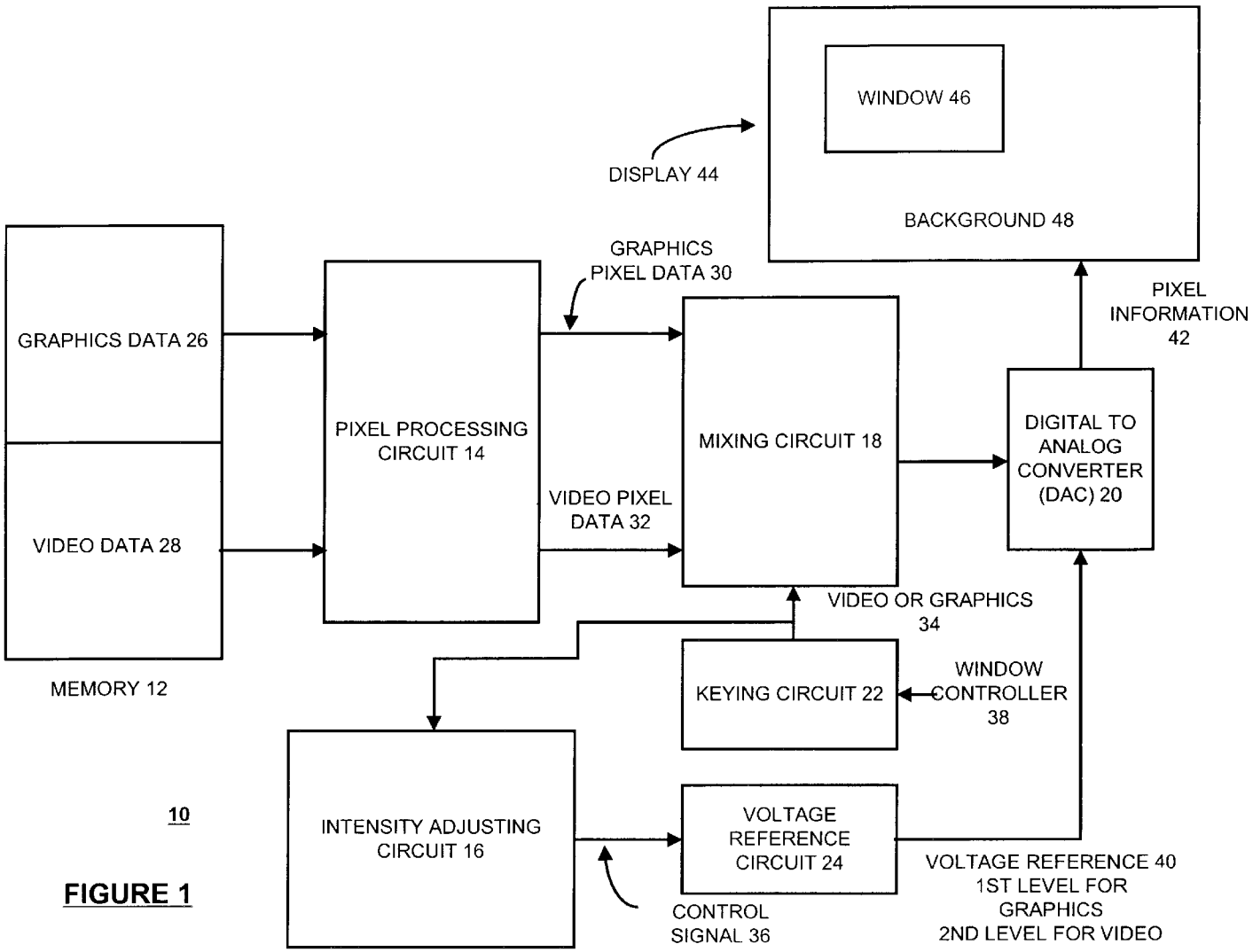
FIG. 1 illustrates a schematic block diagram of a video graphics processing circuit in accordance with the present invention.

The present invention can be more fully described with reference to FIGS. 1 through 4. FIG. 1 illustrates a schematic block diagram of a video graphics processing circuit 10 in accordance with the present invention. The video graphics processing circuit 10 includes memory 12, a pixel processing circuit 14, an intensity adjusting circuit 16, a mixing circuit 18, a digital-to-analog converter (DAC) 20, a keying circuit 22, a voltage reference circuit 24, and a display 44. The memory 12 may be a frame buffer that includes read-only memory, random access memory, electronically reprogrammable memory, system memory, and/or any other device that stores digital information. The memory 12 stores at least a frame's worth of graphics data 28 and/or video data 30. The graphics data 28 is generated by the central processing unit while executing a software application and the video data 30 is generated by a television encoder that digitizes a video source signal received from a DVD player, VCR player, television broadcast, cable broadcast, or satellite broadcast. The data stored in memory 12 is dependent on what is to be displayed. For example, the display 22 may display a background 48 and at least one window 46, where the video data could be displayed in the background 48 and the graphics data in the window 46, or vice versa. As such, the video and/or graphics data is mapped into memory 12 based on the physical coordinates of the window 46 (i.e., where the window appears on the display 24).

When the data stored in memory 12 is to be displayed on display 24, it is retrieved from memory 12 and provided to the pixel processing circuit 14. When the pixel processing circuit 14 receives the graphics data 26, it pipelines the graphics data to produce graphics pixel data 30. In other words, the pixel processing circuit 14 does not alter the properties of the graphics data 26, it just provides it to the mixing circuit 18 in a pipeline fashion. The pixel processing circuit 14, however, when it receives video data 28, converts the video data into video pixel data 32. Such a conversion is known to one of average skill in the art, where the converted video pixel data 32, in prior art systems, would have been provided to the DAC 20 for subsequent display. The present invention, however, further processes the video pixel data 32 as subsequently described.

The pixel processing circuit 14 retrieves the data from the memory 12 based on the pixel location and provides the retrieved graphics data 30 and/or the video pixel data 32 to the mixing circuit 18. The mixing circuit 18 processes the received data and provides the resultant to the DAC 20. The DAC 20 converts, based on the voltage reference 40, the resultant into analog signals that are subsequently displayed on display 22. The mixing circuit 18 may process the received data in a variety ways depending on the desired display. For example, if window 46 is opaque, the mixing circuit 18 passes the video data 32 and/or the graphics data 30, whichever is to be displayed in the window, to the DAC 20. Alternatively, if the window 46 is translucent, the mixing circuit blends the video data 32 with the graphics data 30 and provides the blended data to the DAC 20.

The keying circuit 22 provides a video and/or graphics indication 34 to the mixing circuit 18, which informs the mixing circuit 18 as to how to process the received data. Further note that the keying circuit 22 receives window information from a window controller 38, which indicates when window 46, and other windows (not shown), are to be displayed on display 44. The window controller 38 also provides information as to whether the window is to contain video data or graphics data.

The intensity adjust circuit 16 receives the video or graphics indication 34 and generates a control signal 36 therefrom. The intensity adjust circuit 16 may be a logic circuit that, when the video graphics indication 34 indicates that video is to be displayed, generates a first state of the control signal 36. When the indication 34 indicates that graphics data is to be displayed, the intensity adjust circuit 16 generates a second state of the control signal 36. The control signal 36 is provided to the voltage reference circuit 24 that generates a voltage reference 40 therefrom. For example, if the control signal 36 indicates that graphics data is to be displayed, the voltage reference circuit 24 would produce a first level voltage reference (e.g., 0.7 volts) and when the control signal indicates that video data is to be displayed, the voltage reference circuit 24 would produce a second level voltage reference (e.g., 1.4 volts).

The DAC 20, having received the mixed data from the mixing circuit 18, converts it to an analog signal based on the voltage reference 40. When the DAC 20 is converting graphics data, the first voltage reference (e.g., 0.7 volts) is used to generate pixel information 42, which is an analog signal. If, however, the DAC 20 is processing video data 32, it uses the second voltage reference (e.g., 1.4 volts) to convert the video data 32 into analog pixel information 42. By utilizing a voltage reference (e.g., 1.4 volts) for video data that is greater than the voltage reference (e.g., 0.7 volts) used for graphics data, the intensity of the video data is effectively multiplied by the ratio of the two reference levels (e.g., doubled) with respect to the intensity of the graphics data. As such, the intensity of the video data is increased thereby reducing the perceived visual differences between graphics data and video data. As one of average skilled in the art would appreciate, the ratio between the first and second levels of the voltage reference 40 may vary depending on the desired intensity affects of the graphics data and video data.

Figure 2:
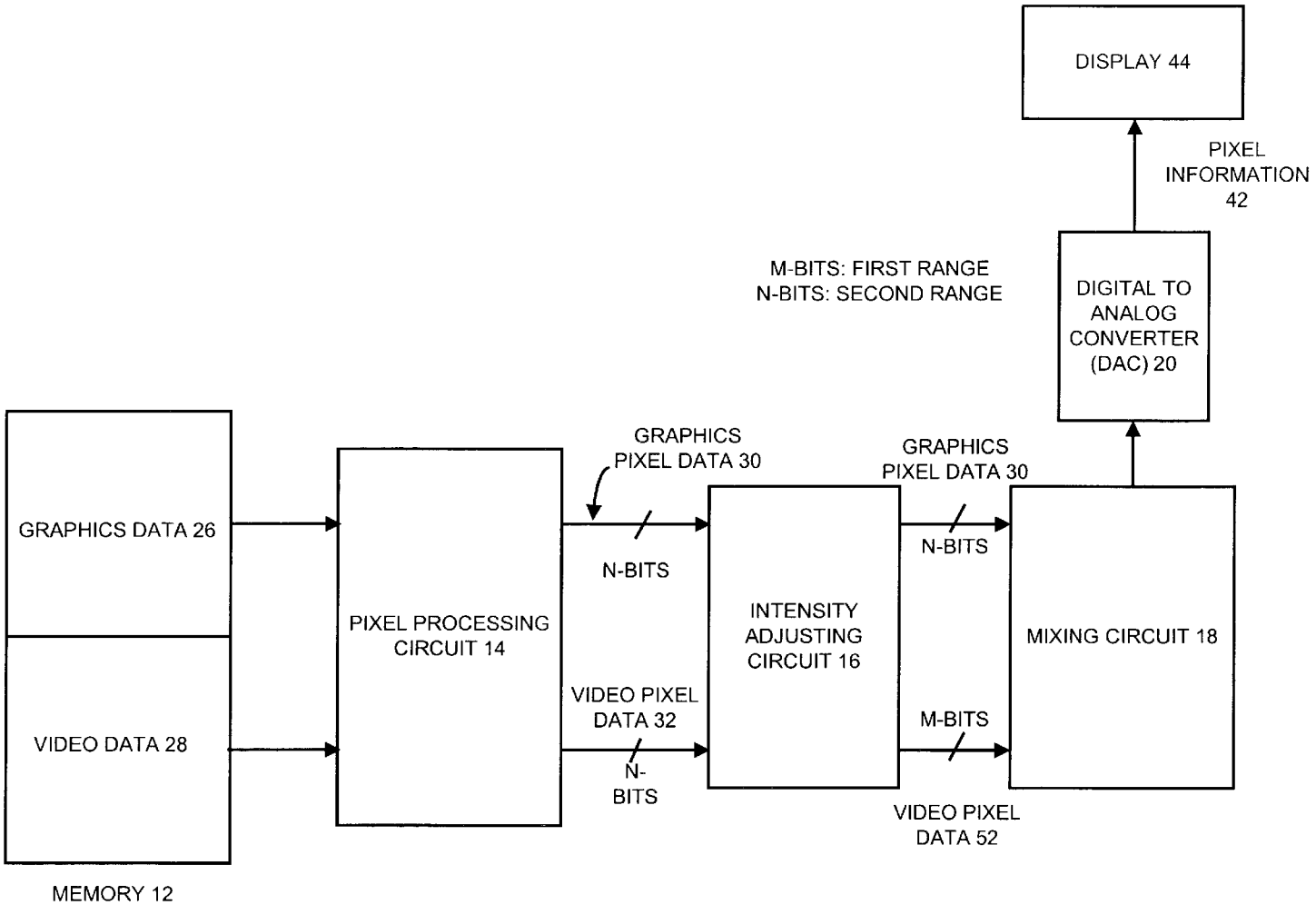
FIG. 2 illustrates a schematic block diagram of an alternate video graphics processing circuit in accordance with the present invention.

FIG. 2 illustrates a schematic block diagram of an alternate video processing circuit 50. The video processing circuit 50 includes the memory 12, the pixel processing circuit 14, the intensity adjust circuit 16, the mixing circuit 18, the DAC 20 and the display 44. The memory 12 and pixel processing circuit 14 function in a similar manner as described with reference to FIG. 1.

The intensity adjusting circuit 16 receives n-bits of graphics pixel data 30 and n-bits of video pixel data 32 from the pixel processing circuit 14. The n-bits may be 8 bits, 16 bits, 24 bits, 32 bits or more of pixel data. The intensity adjust circuit 16, when it is receiving the graphics pixel data 30 passes the graphics pixel data 30, as n-bits of information to the mixing circuit 18. The intensity adjust circuit 16, however, when it is receiving the video pixel data 32 converts the video pixel data into m-bits of information, where m is greater than n. The new video pixel data 52 is then provided to the mixing circuit 18.

The additional bit or bits added to the video pixel data 52 indicate a scaling factor to be used by the mixing circuit 18, or as an indication to provide to the DAC 20, as to the level of voltage reference to use. As such, if a single bit is added to the video pixel data 52, the mixing circuit passes that along to the digital-to-analog converter 20. The DAC, upon reviewing the extra bit, determines whether the voltage reference is to be set at a first level (e.g., 0.7 volts), or a second level (e.g., 1.4 volts). If the extra bit indicates that the voltage reference is to be set at 1.4 volts, the DAC 20 effectively doubles the intensity of the video data, with respect to the graphics data, since the conversion range is twice that of the graphics data.

Figure 3:
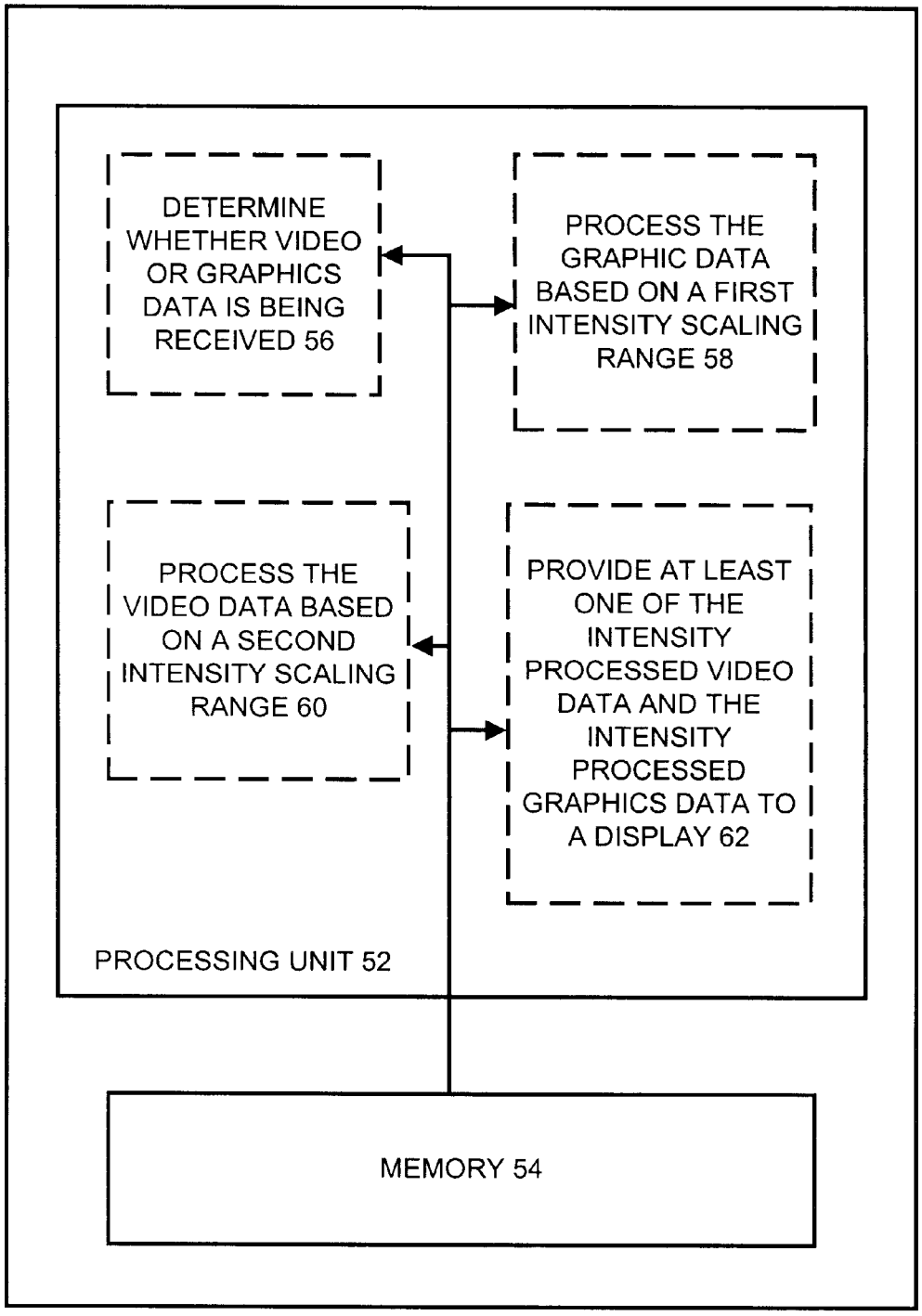
FIG. 3 illustrates a schematic block diagram of another alternate video graphics processing circuit in accordance with the present invention.

FIG. 3 illustrates a schematic block diagram of another alternate video graphics processing circuit 60. The video graphics processing circuit 60 includes a processing unit 62 and memory 64. The processing unit 62 may be a microprocessor, microcontroller, digital signal processor, microcomputer, central processing unit, and/or any other device that manipulates digital information based on programming instructions. The memory 64 may be read-only memory, random access memory, magnetic tape memory, floppy disk memory, hard disk memory, CD ROM memory, DVD ROM memory, and/or any device that stores digital information.

The memory 54 stores programming instructions that, when read by the processing unit 62, causes the processing unit to function as a plurality of circuits 66-72. While reading the programning instructions, the processing unit 62 functions as circuit 66 to determine whether video or graphics data is being received. If graphics data is being received, the processing unit 62 functions as circuit 68 to process the graphics data based on a second intensity scaling range. If video data is being received, the processing unit 62 functions as circuit 70 to process the video data based on a first intensity scaling range. The processing unit 62 then functions as circuit 72 to provide at least one of the intensity process video data and the intensity process graphics data to a display. The programming instructions executed by the processing unit 62 will be discussed in greater detail with reference to FIG. 4.

Figure 4:
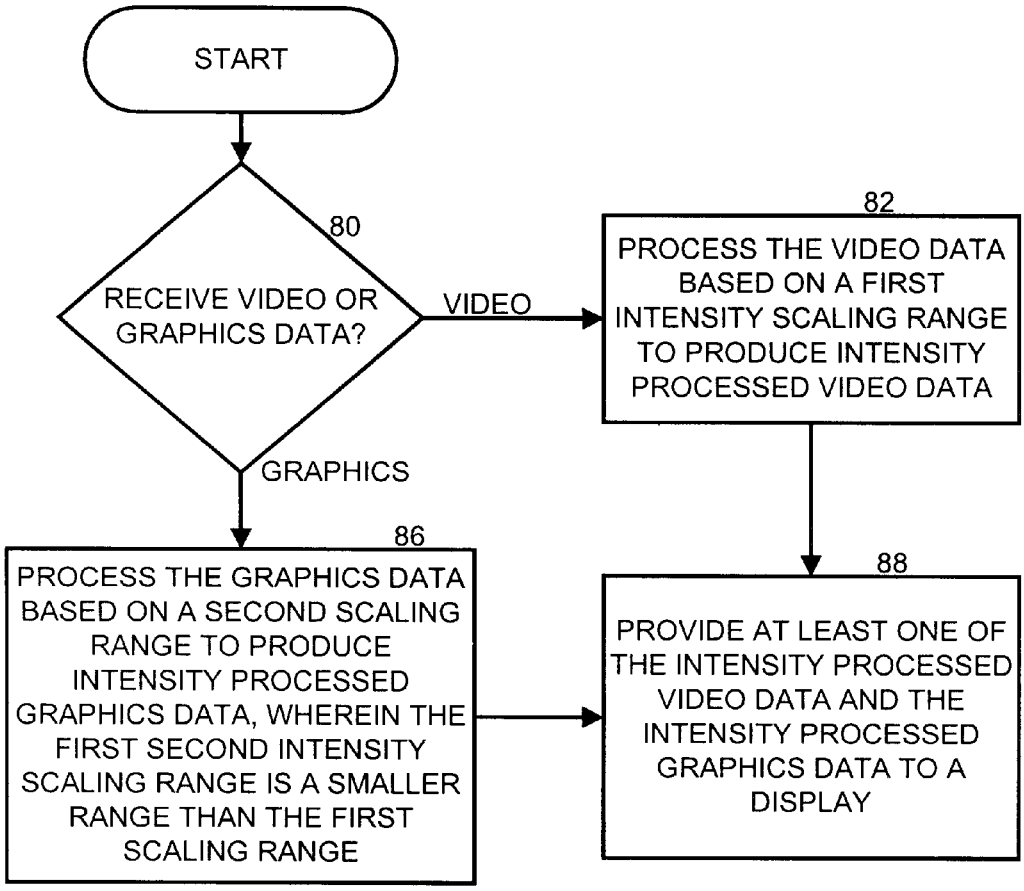
FIG. 4 illustrates a logic diagram of a method for processing video data and graphics data in accordance with the present invention.

FIG. 4 illustrates a logic diagram of a method for processing video and graphics data in accordance with the present invention. The process begins at step 80 where a determination is made as to whether video data or graphics data is received. If video data is received, the process proceeds to step 82 where the video data is processed based on a first intensity scaling range to produce intensity process video data. The first scaling range may be the range from 0.0 volts to 1.4 volts. The first scaling range adjusts a voltage reference of a digital-to-analog converter such that the intensity of the video data is proportionally scaled based on the ratio between the first intensity scaling range and the second intensity scaling range. Alternatively, the first intensity scaling range may be created by adding an extra bit to digitized video data as discussed with reference to FIG. 2.

If, however, the graphics data has been received, the process proceeds to step 86. At step 86 the graphics data is processed based on a second scaling range to produce intensity process graphics data. Note that the second intensity scaling range is smaller than the first intensity scaling range. The second scaling range may be in the range from 0.0 volts to 0.7 volts and may be used to adjust the voltage reference of the digital-to-analog converter. Having produced the intensity processed video data and/or the intensity processed graphics data, the process proceeds to step 88. At step 88 at least one of the intensity processed video data and the intensity processed graphics data is provided to a display. The processing of the data may result from mixing the processed video data with the processed graphics data or simply passing one or the other of the intensity processed data.

The preceding discussion has presented a method and apparatus for processing video data and graphics data utilizing intensity scaling. By increasing the intensity of video data via a separate scaling range, the perceived visual differences between video data and graphics data is substantially reduced. The intensity scaling between video data and graphics data is based on a ratio between the scaling factors. For example, if a scaling factor of 2 to 1 is used, the video data intensity is increased by a factor of 2. As one of average skill in the art would readily appreciate, the scaling of the intensity of the video data may be done in any ratio to the scaling of the intensity of graphics data to produce the desired affects.

What is claimed is:

1. A method for processing video data and graphics data, the method comprises the steps of:

a) determining whether video data is being received or whether graphics data is being received;

b) when the video data is being received, processing the video data based on a first intensity scaling range to produce intensity processed video data;

c) when the graphics data is being received, processing the graphics data based on a second intensity scaling range to produce intensity processed graphics data, wherein the second intensity scaling range is a smaller range than the first intensity scaling range; and d) providing at least one of the intensity processed video data and the intensity processed graphics data to a display.

2. The method of claim 1 further comprises, within steps (b) and (c), establishing the first intensity scaling range to be approximately twice that of the second intensity scaling range.

3. The method of claim 1 further comprises, within steps (b) and (c), establishing the first intensity scaling range by adjusting a DAC voltage reference to a first value, and establishing the second intensity scaling range by adjusting the DAC voltage reference to a second value.

4. The method of claim 1 further comprises, within step (b), establishing the first intensity scaling range by adding an extra bit to the video data.

5. The method of claim 1 further comprises, within step (d), mixing the intensity processed video data and the intensity processed graphics data to produce mixed data, and providing the mixed data to the display.

6. A video graphics processing circuit comprises:

memory that stores video data and graphics data, pixel processing circuit operatively coupled to receive the video data and the graphics data and to respectively produce therefrom video pixel and graphics pixel data, wherein the video pixel data and the graphics pixel data are each n-bits in length; and intensity adjusting circuit operably coupled to the pixel processing circuit, wherein the intensity adjusting circuit adjusts intensity of the video pixel data by converting the n-bit video pixel data into m-bit video pixel data, wherein m is greater than n, wherein resulting additional bits indicate at least one of:

a scaling factor to be used by a mixing circuit, and an indication of voltage reference adjustment for a digital to analog converter.

7. The video graphics processing circuit of claim 6 further comprises a digital to analog converter operably coupled to the intensity adjusting circuit and the pixel processing circuit, wherein the digital to analog converter converts the n-bit graphics pixel data and the m-bit video pixel data into pixel information for subsequent display on a computer display.

8. The video graphics processing circuit of claim 6 further comprises an LCD display operably coupled to receive, and subsequently display, the n-bit graphics pixel data and the m-bit video pixel data.

9. A video graphics processing circuit comprises:

memory that store video data and graphics data;

pixel processing circuit operably coupled to receive the video data and the graphics data and to respectively produce therefrom video pixel data and graphics pixel data;

a digital to analog converter operably coupled to receive the video pixel data and the graphics pixel data, wherein the digital to analog converter produces pixel information from the video pixel data and the graphics pixel data based on a voltage reference; and intensity adjusting circuit operably coupled to the digital to analog converter, wherein the intensity adjusting circuit adjusts the voltage reference to a first value for the video pixel data and a second value for the graphics pixel data, wherein the first value is greater than the second value.

10. The video graphics processing circuit of claim 9 further comprises a mixing circuit that is operably coupled to receive the video pixel data and the graphics pixel data and to produce therefrom mixed pixel data, wherein the mixing circuit provides the mixed pixel data to the digital to analog converter.

11. The video graphics processing circuit of claim 10 further comprises a keying circuit operably coupled to the mixing circuit, wherein the keying circuit provides an indication as to whether the video pixel data or the graphics pixel data is to be mixed by the mixing circuit.

12. A video graphics processing circuit comprises:

a processing unit; and memory that stores programming instructions that, when read by the processing unit, causes the processing unit to (a) determine whether video data is being received or whether graphics data is being received; (b) process the video data based on a first intensity scaling range to produce intensity processed video data when the video data is being received; (c) process the graphics data based on a second intensity scaling range to produce intensity processed graphics data when the graphics data is being received, wherein the second intensity scaling range is a smaller range than the first intensity scaling range; and (d) provide at least one of the intensity processed video data and the intensity processed graphics data to a display.

13. The video graphics processing circuit of claim 12 further comprises, within the memory, programming instructions that, when read by the processing unit, causes the processing unit to establish the first intensity scaling range to be from 0.0 volts to 1.4 volts and establishing the second intensity scaling range to be from 0.0 volts to 0.7 volts.

14. The video graphics processing circuit of claim 12 further comprises, within the memory, programming instructions that, when read by the processing unit, causes the processing unit to establish the first intensity scaling range by adjusting a DAC voltage reference to a first value, and establishing the second intensity scaling range by adjusting the DAC voltage reference to a second value.

15. The video graphics processing circuit of claim 12 further comprises, within the memory, programming instructions that, when read by the processing unit, causes the processing unit to establish the first intensity scaling range by adding an extra bit to the video data.

16. The video graphics processing circuit of claim 12 further comprises, within the memory, programming instructions that, when read by the processing unit, causes the processing unit to mix the intensity processed video data and the intensity processed graphics data to produce mixed data, and providing the mixed data to the display.

* * * * *